US006501918B1

(12) United States Patent
Fujimoto et al.

(10) Patent No.: US 6,501,918 B1
(45) Date of Patent: Dec. 31, 2002

(54) TONER CONCENTRATION CONTROLLING APPARATUS

(75) Inventors: Kenzo Fujimoto, Hyogo (JP); Ikuo Takeda, Hyogo (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/984,539

(22) Filed: Oct. 30, 2001

(30) Foreign Application Priority Data

Jul. 27, 2001 (JP) ..... 2001-227852

(51) Int. Cl.[7] ..... G03G 15/08

(52) U.S. Cl. ..... 399/58; 399/59; 399/61; 118/694

(58) Field of Search ..... 118/694; 399/27, 399/29, 30, 58, 59, 61, 62, 258, 259

(56) References Cited

U.S. PATENT DOCUMENTS 6,006,050 A * 12/1999 Watanabe et al. ..... 399/58

FOREIGN PATENT DOCUMENTS

JP 9-062084 3/1997

* cited by examiner

*Primary Examiner*—Hoang Ngo
(74) *Attorney, Agent, or Firm*—Armstrong, Westerman & Hattori, LLP

(57) ABSTRACT

A concentration controlling apparatus is provided for controlling the toner concentration of a developer contained in a developer unit. The developer contains a plurality of components including toner to be transferred to a photosensitive body for forming an electrostatic latent image. The concentration controlling apparatus includes a toner concentration detector for detecting the toner concentration of the developer, a supply determiner for determining a need for toner supply in response to detection output from the toner concentration detector, and a toner supplier for supplying a dose of the toner to the developer unit in accordance with the determination by the supply determiner. The supply determiner determines the need for toner supply at a higher toner concentration in a print-off state than in a print-on state.

11 Claims, 6 Drawing Sheets

TONER CONCENTRATION CONTROLLING APPARATUS

BACKGROUND OF THE INVENTION

1. Field of the Invention

The present invention relates to a toner concentration controlling apparatus for controlling the toner concentration of a two-component developer for use in an electrophotographic printer for example.

2. Description of the Related Art

As a demand increases for a high-speed computer system operating with high-reliability, a printer capable of printing at a high speed while also providing good printing results is also increasingly demanded. Such a high-speed printer generally uses a developer consisting of a plurality of components including toner. For example, use may be made of a two-component developer consisting of toner and carrier (magnetic particles).

In a printer using such a two-component developer, the toner concentration of the developer stored in a developer unit decreases as the printing operation proceeds, so that an additional dose of the toner need be supplemented to the developer unit. The toner supply may be performed under the control of a toner concentration controlling apparatus.

A toner concentration controlling apparatus typically incorporates a sensor for detecting the toner concentration of a developer. When the sensor outputs a detection voltage which exceeds a predetermined threshold value, it is determined that the toner concentration has dropped to a level which requires additional toner supply. Thus, an additional amount of the toner is supplied to the developer unit.

With such a toner concentration controlling apparatus, the toner is supplied regardless of whether the printer is in a print-on state or in a print-off state in performing intermittent printing. However, immediately after the toner is supplied to the developer unit, the additional dose of the toner is not sufficiently mixed with the developer remaining in the developer unit, so that an excessive amount of the toner may adhere onto a recording paper. Here, by the term "intermittent printing" is meant any mode of printing (other than a continuous job of printing a large number of pages) where a certain pause exists between jobs of printing.

SUMMARY OF THE INVENTION

It is therefore an object of the present invention to provide a toner concentration controlling apparatus which is capable of reducing the likelihood that a dose of the toner is supplied in a print-on state in performing intermittent printing.

In accordance with the present invention, there is provided a concentration controlling apparatus for controlling toner concentration of a developer contained in a developer unit, the developer comprising a plurality of components including toner to be transferred to a photosensitive body for forming an electrostatic latent image. The concentration controlling apparatus comprises a toner concentration detector for detecting the toner concentration of the developer, a supply determiner for determining a need for toner supply in response to detection output from the toner concentration detector, and a toner supplier for supplying a dose of the toner to the developer unit in accordance with the determination by the supply determiner. The supply determiner determines the need for toner supply at a higher toner concentration in a print-off state than in a print-on state.

In a first embodiment, the supply determiner determines the need for toner supply by comparing the detection output with different threshold values in the print-on state and in the print-off state, respectively. Preferably, the supply determiner compares the detection output with a higher threshold value in the print-on state while comparing the detection output with a lower threshold value in the print-off state.

In a second embodiment, the supply determiner adjusts the detection output of the toner concentration detector produced in either one of the print-on state and the print-off state, and the supply determiner determines the need for toner supply by comparing the adjusted detection output with a common threshold value in said one of the print-on state and the print-off state while comparing the non-adjusted detection output with the common threshold value in the other of the print-on state and the print-off state. Preferably, the supply determiner multiplies the detection output of the toner concentration detector by a constant of greater than one only in the print-off state, and the supply determiner compares the multiplied detection output with the common threshold value in the print-off state while comparing the non-multiplied detection output with the common threshold value in the print-on state.

In a third embodiment, the toner concentration detector is supplied with a voltage to produce a detection output which varies in accordance with the voltage applied to the toner concentration detector even if the toner concentration does not change, and the controller further comprises a voltage controller for applying different voltages to the toner concentrating detector in the print-on state and in the print-off state, respectively. Preferably, the toner concentration detector is supplied with a higher voltage in the print-off state than in the print-on state.

In a fourth embodiment, the toner concentration controlling apparatus also comprises an agitator provided in the developer unit for agitating the developer, wherein the detection output of the toner concentration detector varies in accordance with the agitating speed of the agitating device. The apparatus further comprises an agitating speed controller for providing different agitating speeds of the agitator in the print-on state and in the print-off state, respectively.

In the fourth embodiment, the agitating speed controller preferably causes the agitator to agitate at a lower speed in the print-off state than in the print-on state. In this case, the toner concentration controlling apparatus may further comprise a development bias controller for providing a higher development bias in the print-off state than in the print-on state.

Other objects, features and advantages of the present invention will be apparent from the following description of the preferred embodiments given with reference to the accompanying drawings.

DETAILED DESCRIPTION OF THE PREFERRED EMBODIMENT

Preferred embodiments of the present invention will be described below in detail with reference to the accompanying drawings.

Figure 1:
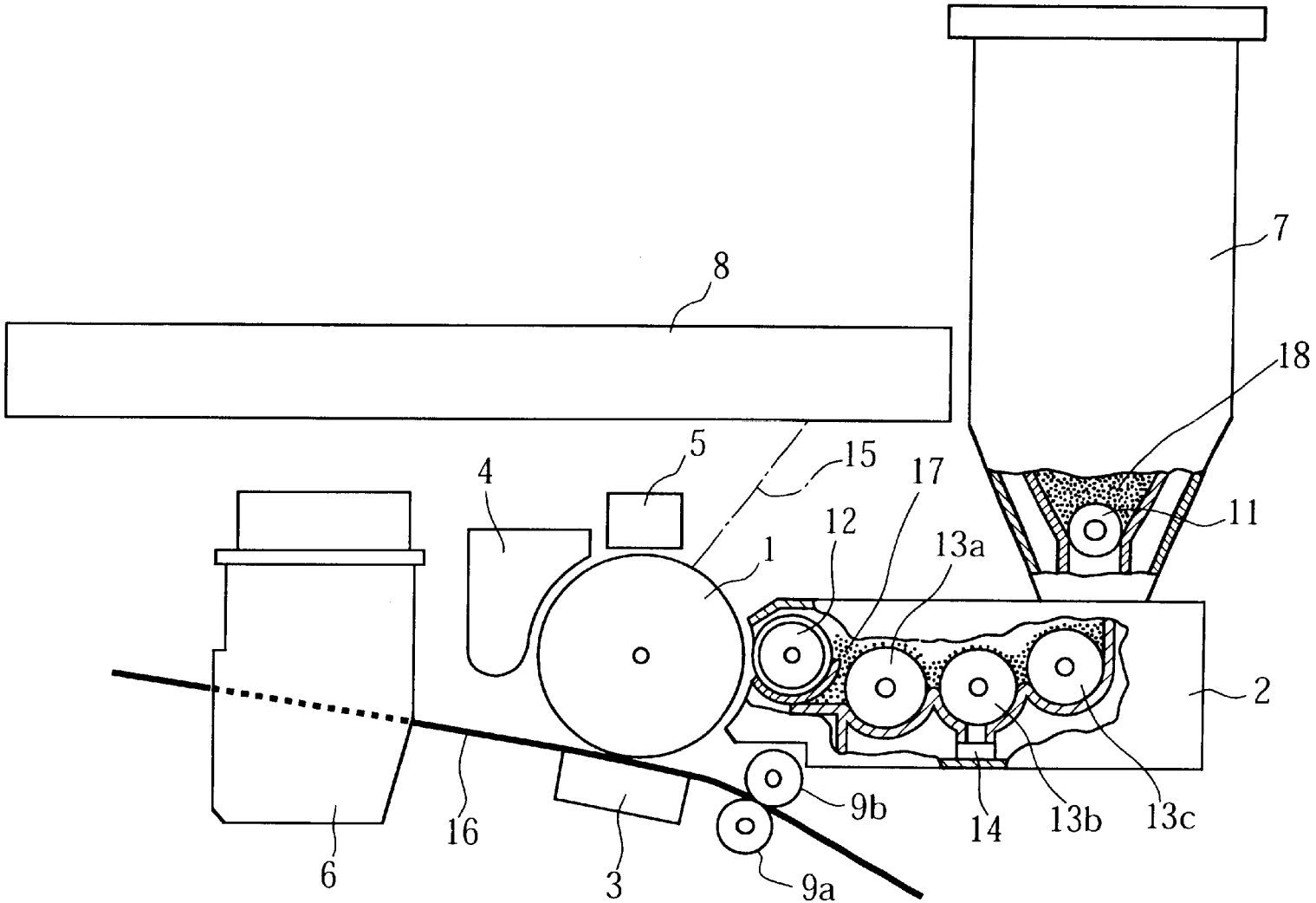
FIG. 1 is a schematic view illustrating a printer incorporating a toner concentration controlling apparatus according to the present invention.

FIG. 1 schematically illustrates a printer incorporating a concentration controlling apparatus according to the present invention. The illustrated printer includes a photosensitive drum 1, a developer unit 2, a transfer/discharge unit 3, a cleaning blade 4, a charger 5, a fixing unit 6, a toner hopper 7, an optical unit 8, and a pair of paper transporting rollers 9*a*, 9*b*. The toner hopper 7 for storing toner 18 incorporates a toner supply roller 11. The developer unit 2 for storing a two-component developer 17 consisting of toner 18 and magnetic carrier particles incorporates a magnet roll 12, three agitating rollers 13*a*, 13*b*, 13*c* and a toner concentration detecting sensor 14.

The photosensitive drum 1 has a circumferential surface which is charged by the charger 5. The surface of the photosensitive drum 1 is then exposed to a laser beam emitted from the optical unit 8 at portions selected in accordance with the printing or image data. As a result, an electrostatic latent image is formed on the surface of the photosensitive drum 1. The electrostatic latent image is developed by the developer unit 2 to provide a visible toner image. The toner image on the surface of the photosensitive drum 1 is transferred by the transfer/discharge unit 3 onto a recording paper 16 which is transported by the paper transporting rollers 9*a*, 9*b* in synchronism with the rotation of the photosensitive drum 1. The static electricity remaining on the surface of the drum 1 is removed by the transfer/discharge device 3. Further, an excessive amount of toner 18 remaining on the surface of the photosensitive drum 1 is scraped off by the cleaning blade 4.

Specifically, the toner 18 supplied from the toner hopper 7 into the developer unit 2 by the rotation of the toner supply roller 11 is transported toward the magnet roll 12 while being agitated by the agitating roller 13*a*, 13*b*, 13*c*. Then, by the rotation of the magnet roll 12, the toner 18 is transferred toward the circumferential surface of the photosensitive drum 1 for adhesion to non-charged portions of the drum surface. The toner concentration of the developer in the developer unit 2 is detected by the toner concentration sensor 14 disposed below the agitating roller 13*b*. The toner concentration sensor 14 incorporates a coil for outputting a detection voltage in accordance with the magnetic permeability of the two-component developer 17.

Figure 2:
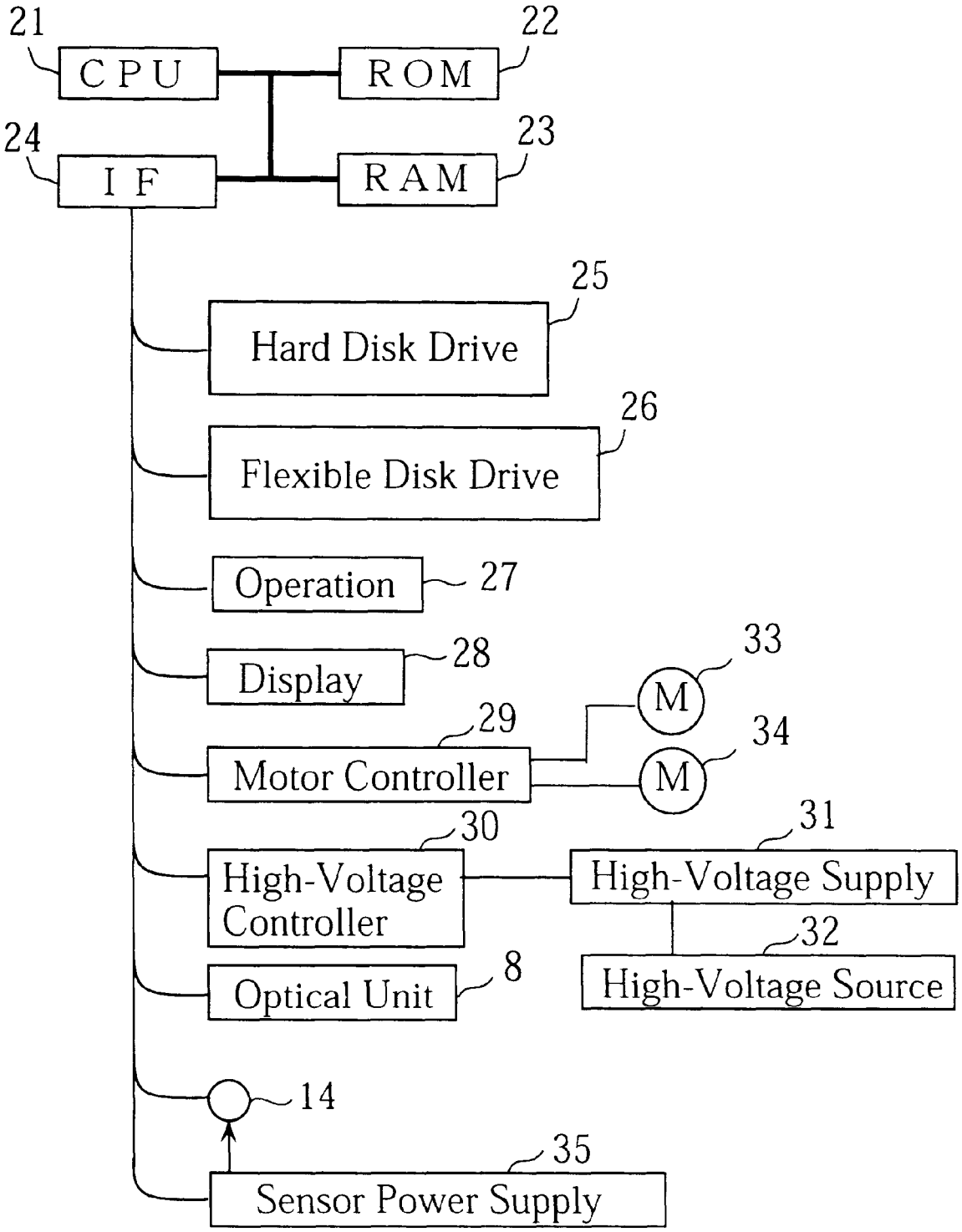
FIG. 2 is a block diagram of the printer shown in FIG. 1.

FIG. 2 is a block diagram of the printer shown in FIG. 1. As shown in this figure, the printer includes a CPU 21, a ROM 22, a RAM 23, an interface 24, a hard disk drive 25, a flexible disk drive 26, an operation section 27, a display section 28, a motor controller 29, a high-voltage controller 30 and a sensor power supply section 35 in addition to the optical unit 8 and the toner concentration sensor 14. The high-voltage controller 30 is connected to a high-voltage supply section 31, which in turn is connected to a high-voltage power source 32. The motor controller 29 is connected to motors 33, 34.

The CPU (central processing unit) 21 provides overall control of the printer.

The ROM (read only memory) 22 stores basic programs and the like.

The RAM (random access memory) 23 provides the CPU 21 with a work area while also storing various data.

The interface 24 controls communication between the CPU 21 and the peripheral devices.

The hard disk drive 25 writes data to and reads data from a non-illustrated hard disk. The hard disk may further store the record data read out from a flexible disk (not shown) via the flexible disk drive 26 or transmitted from a non-illustrated computer for example.

The flexible disk drive 26 writes data to and reads data from a non-illustrated flexible disk.

The operation section 27 may be provided with a plurality of key switches (not shown) which output operation data in accordance with the operation by the operator.

The display section 28 may be provided with a non-illustrated LCD (liquid crystal display) for showing various kinds of information.

The motor controller 29 controls the motor 33 for driving the photosensitive drum 1, the magnet roll 12 and the agitating rollers 13*a*, 13*b*, 13*c*, and the motor 34 for driving the toner supply roller 11.

The high-voltage controller 30 controls the high-voltage supplying section 31 for supplying a high voltage from the high-voltage source 32 to the developer 2 and the charger 5 for example.

The sensor power supply section 35 supplies a predetermined voltage to the toner concentration sensor 14.

The optical unit 8 emits a laser beam 15 for selectively irradiating the surface of the photosensitive drum 1 in accordance with the printing or image data for forming an electrostatic latent image on the drum surface.

Now, description is made as to how the toner concentration is controlled in the above-described printer.

The toner concentration of the two-component developer 17 in the developer unit 2 is detected by the toner concentration sensor 14. Specifically, the sensor 14, to which a predetermined voltage is applied by the sensor power supply section 35, outputs a detection voltage indicative of the toner concentration of the two-component developer 17. The lower the toner concentration is, the higher the detection voltage is.

Then, the CPU 21, which serves as a supply determiner, compares the detection voltage outputted from the toner concentration sensor 14 with a predetermined threshold. According to the present invention, different threshold values are used for the print-on state and the print-off state, respectively.

Figure 3:
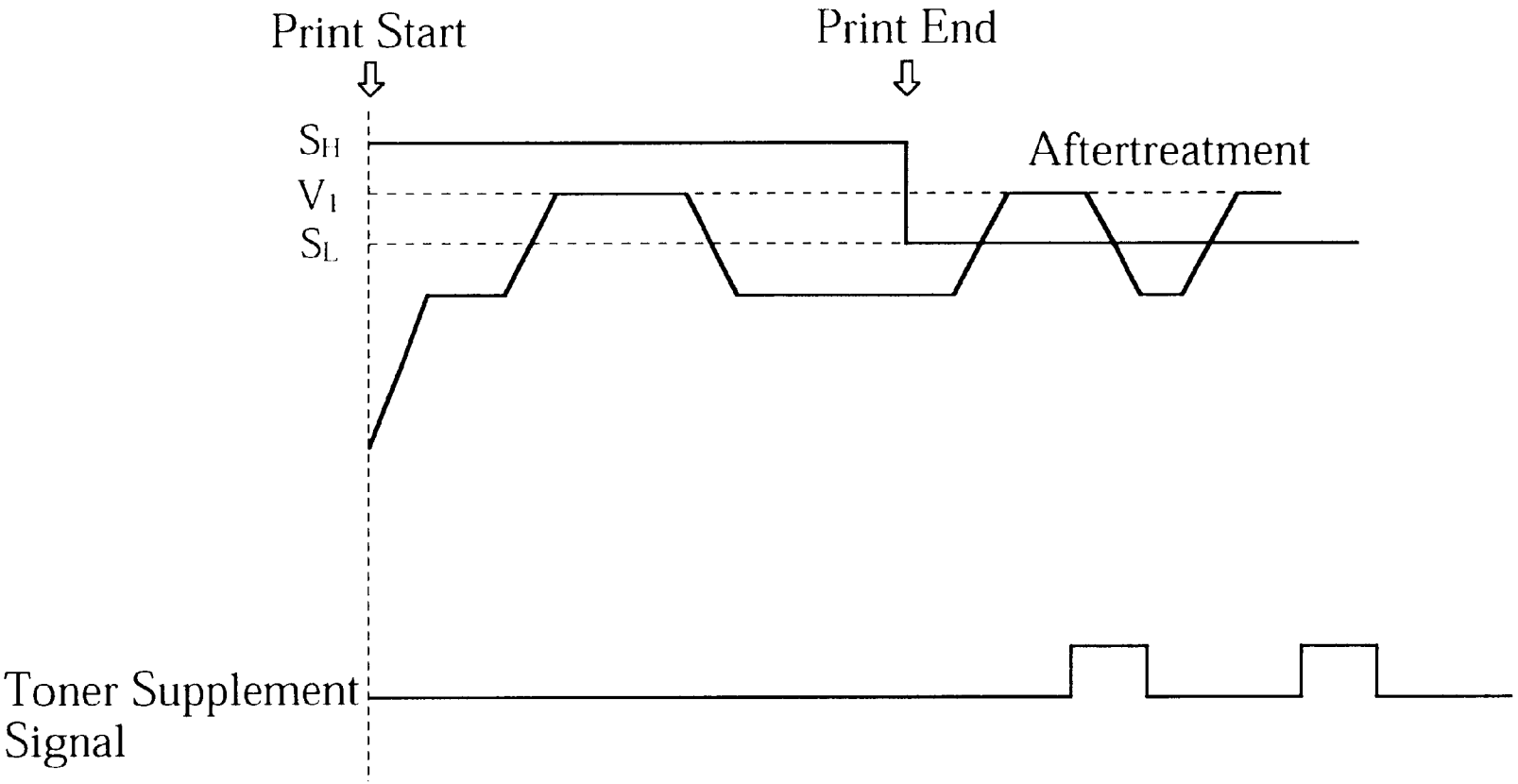
FIG. 3 illustrates signal wave-forms at different parts of the concentration controlling apparatus according to an embodiment of the present invention.

Specifically, as shown in FIG. 3, a higher value $S_H$ is set as the threshold for the print-on state. The value $S_H$ may be the one which is used for conventional concentration control. On the other hand, a lower value $S_L$ is set as the threshold for the print-off state.

Now, it is assumed that a detection voltage $V_1$, which satisfies the inequality $S_L<V_1<S_H$, is outputted both in the print-on state and in the print-off state. In the print-on state, the CPU 21 compares the detection voltage $V_1$ with the higher threshold value SH. Since the detection voltage $V_1$ is lower than the threshold value SH, the CPU 21 does not output a toner-supply instruction signal. On the other hand, in the print-off state, the CPU 21 compares the detection voltage $V_1$ with the lower threshold value $S_L$. Since the detection voltage $V_1$ is higher than the threshold value $S_L$, the CPU 21 outputs a toner-supply instruction signal to the motor controller 29. In response to this toner-supply instruction signal, the motor controller 29 drives the motor 34 for rotating the toner supply roller 11, thereby supplementing a dose of the toner 18 in the toner hopper 7 to the developer unit 2. As a result, the amount of the toner 18 in the developer unit 18 increases to such a level as to enable the printer to print on at least ten more sheets of recording paper 16 for example without fainting the print.

As described above, according to the present invention, toner supply is more likely to occur in the print-off state than in the print-on state before the toner concentration drops to a significant level. Therefore, it is possible to reduce the possibility that toner supply occurs in the print-on state, thereby preventing an excessive amount of toner from adhering locally onto the recording paper 16.

According to a second embodiment of the present invention, a single threshold value may be used commonly for the print-on state and the print-off state. In this case, adjustment is made with respect to the detection voltage outputted either in the print-on state or in the print-off state before comparison with the threshold value.

Figure 4:
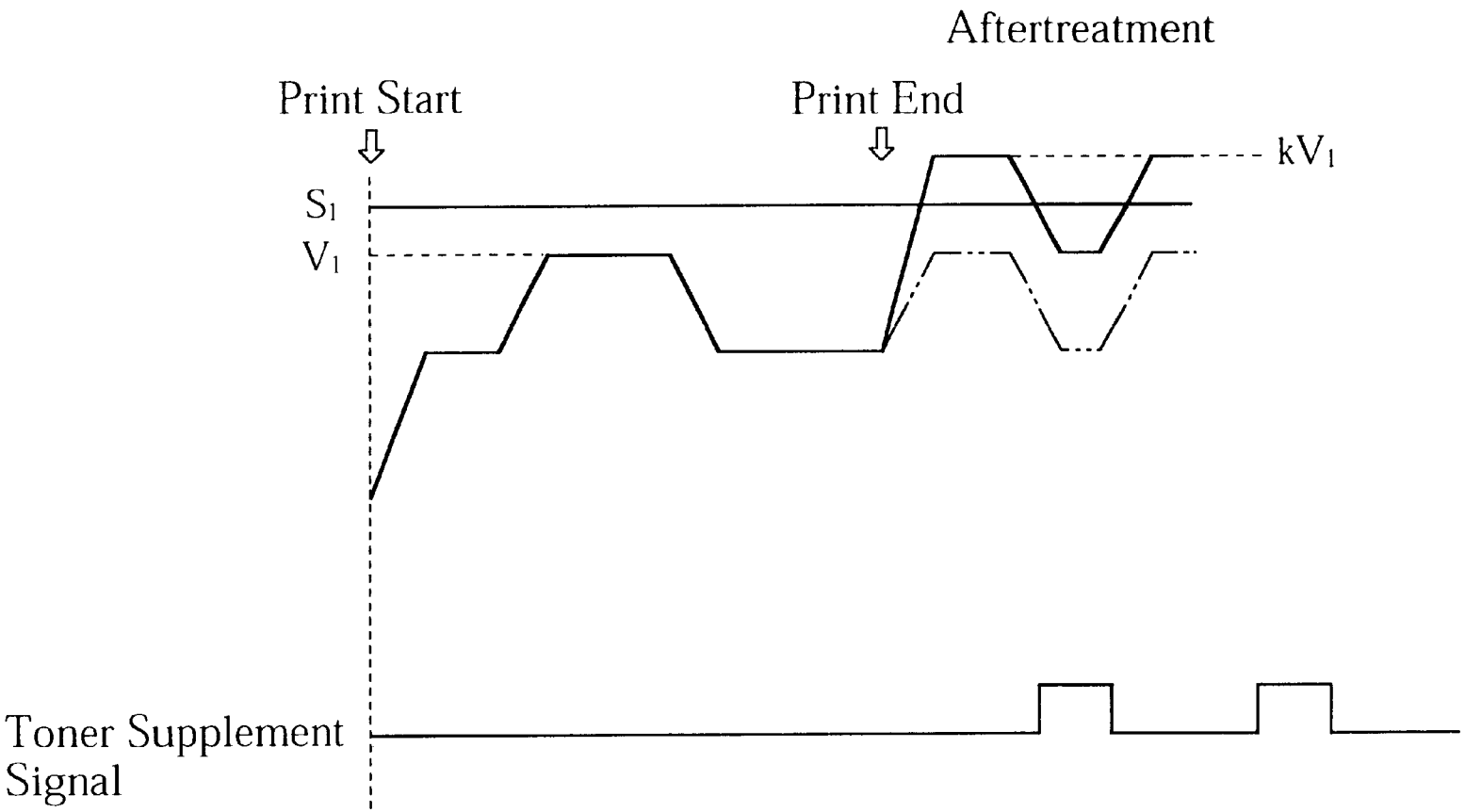
FIG. 4 illustrates signal wave-forms at different parts of the concentration controlling apparatus according to another embodiment of the present invention.

Specifically, as shown in FIG. 4, a value $S_1$ is set as a threshold used commonly for both the print-on state and the print-off state. Further, the detection voltage outputted from the toner concentration sensor 14 in the print-off state, for example, is multiplied by a constant k, which is greater than one, before comparison with the threshold value $S_1$.

Now, it is assumed that a detection voltage $V_1$, which satisfies the inequality $V_1<S_1<kV_1$, is outputted both in the print-on state and in the print-off state. In the print-off state, the CPU 21 compares the adjusted detection voltage $kV_1$ with the threshold value S1. Since the adjusted detection voltage $kV_1$ is higher than the threshold value $S_1$, the CPU 21 outputs a toner supply instruction signal. On the other hand, in the print-on state, the CPU 21 compares the detection voltage $V_1$ with the threshold value $S_1$. Since detection voltage $V_1$ is lower than the threshold value $S_1$, the CPU 21 does not demand toner supply. Thus, also with this design, it is possible to obtain the same advantages as those of the first embodiment in which two different threshold values are used for the print-on state and the print-off state.

In each of the above-described first and the second embodiments, a constant voltage is applied to the toner concentration sensor 14 regardless of the print-on state or the print-off state. According to a third embodiment of the present invention, different voltages are applied to the toner concentration sensor 14 in the print-on state and in the print-off state, respectively. This function may be realized by the CPU 21.

Figure 5:
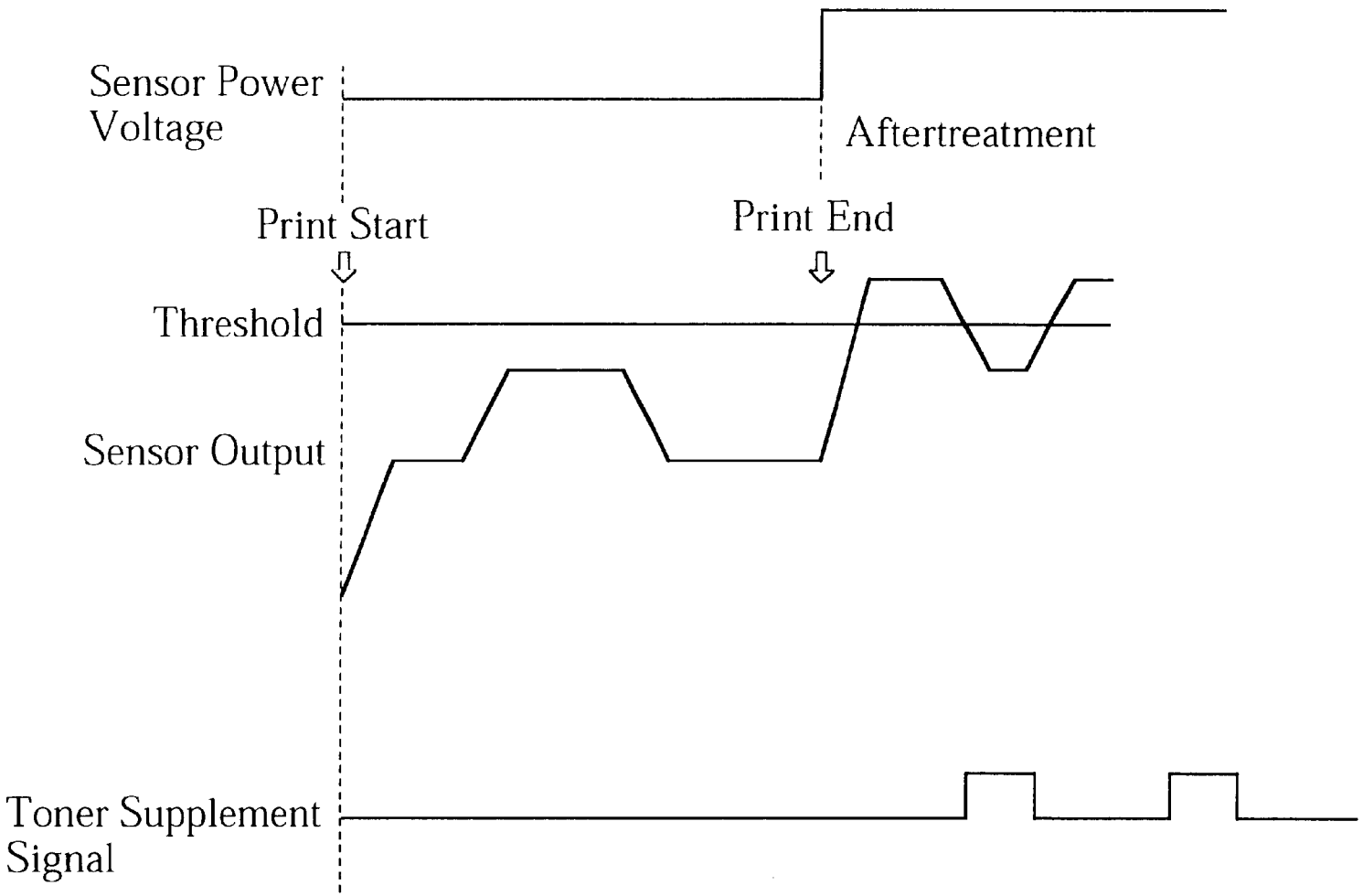
FIG. 5 illustrates signal wave-forms at different parts of the concentration controlling apparatus according to still another embodiment of the present invention.

Specifically, as shown in FIG. 5, the CPU 21 controls the sensor power supply section 35 to apply a higher voltage to the sensor 14 in the print-off state than in the print-on state. The higher the applied voltage is, the higher is the detection voltage from the sensor 14. Therefore, the design of the third embodiment has the same advantages as those obtained in the case where the detection voltage outputted in the print-off state is multiplied by a constant k which is greater than one.

In each of the above-described embodiments, the two-component developer 17 in the developer unit 2 is agitated by the agitating rollers 13*a*, 13*b*, 13*c* at a constant agitating speed. According to a fourth embodiment, however, the CPU 21 serves as an agitating speed controller for providing different agitating speeds in the print-off state and in the print-on state, respectively.

Figure 6:
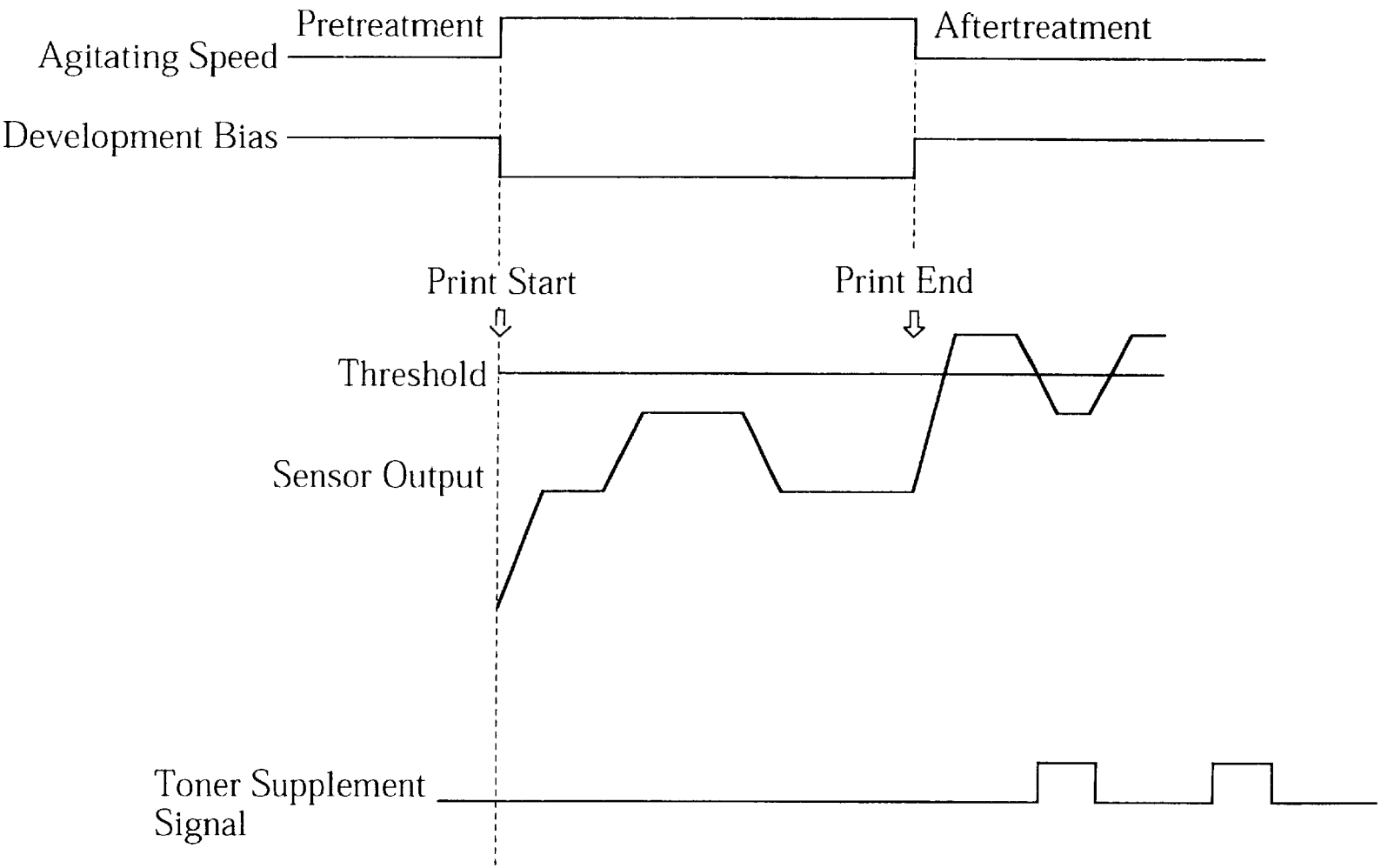
FIG. 6 illustrates signal wave-forms at different parts of the concentration controlling apparatus according to a further embodiment of the present invention.

Specifically, as shown in FIG. 6, the CPU 21 controls the motor controller 29 to provide a lower rotational speed of the agitating rollers 13*a*, 13*b*, 13*c* in the print-off state than in the print-on state. The lower the agitating speed is, the higher is the detection voltage outputted by the sensor 14. Therefore, the design of the fourth embodiment has the same advantages as those obtained in the case where the detection voltage outputted in the print-off state is multiplied by a constant k which is greater than one.

According to the fourth embodiment, the CPU 21 may control the high-voltage controller 30 to provide a higher development bias in the print-off state than in the print-on state. This is because, in the print-off state, or when the rotational speed of the agitating rollers 13*a*, 13*b*, 13*c* is low, the toner 18 is readily transferred to the photosensitive drum 1, which may lead to the so-called fogging. However, by increasing the development bias in the print-off state, the toner 18 becomes less likely to be attracted onto the photosensitive drum 1, which leads to the prevention of the fogging.

The present invention being thus described, it is apparent that the same may be varied in many ways. Such variations should not be regarded as a departure from the spirit and scope of the present invention, and all such modifications as would be obvious to those skilled in the art are intended to be included within the scope of the following claims.

What is claimed is:

1. A concentration controlling apparatus for controlling toner concentration of a developer contained in a developer unit, the developer comprising a plurality of components including toner to be transferred to a photosensitive body for forming an electrostatic latent image, the concentration controlling apparatus comprising:

a toner concentration detector for detecting the toner concentration of the developer;

a supply determiner for determining a need for toner supply in response to detection output from the toner concentration detector; and a toner supplier for supplying a dose of the toner to the developer unit both in a print-off state and a print-on state in accordance with the determination by the supply determiner;

wherein the supply determiner determines the need for toner supply at a higher toner concentration in the print-off state than in the print-on state.

2. The toner concentration controlling apparatus according to claim 1, wherein the supply determiner determines the need for toner supply by comparing the detection output with different threshold values in the print-on state and in the print-off state, respectively.

3. The toner concentration controlling apparatus according to claim 2, wherein the supply determiner compares the detection output with a higher threshold value in the print-on state while comparing the detection output with a lower threshold value in the print-off state.

4. The toner concentration controlling apparatus according to claim 1, wherein the supply determiner adjusts the detection output of the toner concentration detector produced in either one of the print-on state and the print-off state, the supply determiner determining the need for toner supply by comparing the adjusted detection output with a common threshold value in said one of the print-on state and the print-off state while comparing the non-adjusted detection output with the common threshold value in the other of the print-on state and the print-off state.

5. The toner concentration controlling apparatus according to claim 4, wherein the supply determiner multiplies the detection output of the toner concentration detector by a constant of greater than one only in the print-off state, the supply determiner comparing the multiplied detection output with the common threshold value in the print-off state while comparing the non-multiplied detection output with the common threshold value in the print-on state.

6. The toner concentration controlling apparatus according to claim 1, wherein the toner concentration detector is supplied with a voltage to produce a detection output which varies in accordance with the voltage applied to the toner concentration detector even if the toner concentration does not change, the controller further comprising a voltage controller for applying different voltages to the toner concentrating detector in the print-on state and in the print-off state, respectively.

7. The toner concentration controlling apparatus according to claim 6, wherein the toner concentration detector is supplied with a higher voltage in the print-off state than in the print-on state.

8. The toner concentration controlling apparatus according to claim 1, further comprising:

an agitator provided in the developer unit for agitating the developer, the detection output of the toner concentration detector varying in accordance with the agitating speed of the agitating device, and an agitating speed controller for providing different agitating speeds of the agitator in the print-on state and in the print-off state, respectively.

9. The toner concentration controlling apparatus according to claim 8, wherein the agitating speed controller causes the agitator to agitate at a lower speed in the print-off state than in the print-on state.

10. The toner concentration controlling apparatus according to claim 9, further comprising a development bias controller for providing a higher development bias in the print-off state than in the print-on state.

11. A concentration controlling apparatus for controlling toner concentration of a developer contained in a developer unit, the developer comprising a plurality of components including toner to be transferred to a photosensitive body for forming an electrostatic latent image, the concentration controlling apparatus comprising:

a toner concentration detector for detecting the toner concentration of the developer;

a supply determiner for determining a need for toner supply in response to detection output from the toner concentration detector;

a toner supplier for supplying a dose of the toner to the developer unit in accordance with the determination by the supply determiner;

wherein the supply determiner determines the need for toner supply at a higher toner concentration in a print-off state than in a print-on state; and wherein the toner concentration detector is supplied with a voltage to produce a detection output which varies in accordance with the voltage applied to the toner concentration detector even if the toner concentration does not change, the controller further comprises a voltage controller for applying different voltages to the toner concentrating detector in the print-on state and in the print-off state, respectively.

* * * * *